US006443452B1

(12) United States Patent
Brune

(10) Patent No.: US 6,443,452 B1
(45) Date of Patent: Sep. 3, 2002

(54) FREE GAME PRIZING METHOD AND APPARATUS FOR AN ELECTRONIC GAMING TERMINAL

(75) Inventor: Chris T. Brune, Reno, NV (US)

(73) Assignee: International Game Technology, Reno, NV (US)

( * ) Notice: Subject to any disclaimer, the term of this patent is extended or adjusted under 35 U.S.C. 154(b) by 0 days.

(21) Appl. No.: 09/503,562

(22) Filed: Feb. 14, 2000

Related U.S. Application Data

(60) Provisional application No. 60/153,588, filed on Sep. 13, 1999.

(51) Int. Cl.[7] ..... G07F 17/34
(52) U.S. Cl. ..... 273/143 R; 463/20; 463/25
(58) Field of Search ..... 273/143 R, 138.2; 463/20, 25–29

(56) References Cited

U.S. PATENT DOCUMENTS 3,889,956 A 6/1975 Castle ..... 273/138
5,067,712 A * 11/1991 Georgalis ..... 273/143 R
5,453,928 A 9/1995 Kaminkow et al. ..... 364/411
5,513,846 A * 5/1996 Niederlein et al. ..... 273/143 R
5,785,316 A * 7/1998 Schulze ..... 273/142 H
5,851,148 A 12/1998 Brune et al. ..... 463/25

* cited by examiner

*Primary Examiner*—Benjamin H. Layno
(74) *Attorney, Agent, or Firm*—George H. Gerstman; Seyfarth Shaw

(57) ABSTRACT

A gaming terminal provides at least a portion of at least one prize in the form of at least one or more free game rounds. A benefit may be calculated as the difference between the value of the prize if paid out in coins or other monetary value and the value paid out as free game rounds. In one aspect, the benefit is redistributed in the paytable, preferably so as to provide a game in which the overall, long-term averaged payback amount is unchanged by the process of converting monetary payouts to free game payouts and redistributing the benefit thereof.

18 Claims, 2 Drawing Sheets

FREE GAME PRIZING METHOD AND APPARATUS FOR AN ELECTRONIC GAMING TERMINAL

This application claims the benefit of U.S. provisional application No. 60/153,588, filed Sep. 13, 1999.

The present invention relates to a method and apparatus for adding free games as some of the prizes in an electronic gaming terminal and in particular to a method which can be used to increase the relative payback for larger-valued prizes without the need to decrease gaming terminal holds.

BACKGROUND INFORMATION

In general, for a given gaming terminal or gaming system, it is possible to characterize the long-term averaged payout or payback ratio (i.e., the amount awarded, in prizes, to players, averaged over a long time period, per unit wager) as a function of the size of the various prizes and the frequency with which the various prizes are awarded or won. The hold portion (i.e., the amount retained by the casino or other game operator) is, thus, one minus the payback ratio. A number of payback ratios are used in different games. By way of example, it is not uncommon to have a 90% payback ratio for many slot machines.

The success or usefulness of a gaming terminal or system, to a gaming operator, however, is related not only to the payback ratio or hold but also to how much of the time the gaming terminal or system is in use and the rate at which it is played, which can generally be understood in terms of the game's attractiveness to players. Many factors can affect the attractiveness of a game. In addition to factors such as appearance, theme, setting, and so forth, players are often influenced by the perceived (or believed) payback which a machine provides. Players often differ widely in what types of paybacks are considered most attractive. While some players are most satisfied with games which provide a relatively large number of relatively smaller prizes, other players are concerned principally with the frequency at which large prizes are awarded. In this context, unless indicated otherwise, large prizes, as used herein, will be considered prizes which are at least five (5) times, and preferably at least ten (10) times, the amount of the wager.

Certain electronic gaming terminals or systems are configured such that, as a result of certain predefined game outcomes, one or more free plays of the game are awarded as a prize. Typical previous systems, however, have certain undesirable aspects. Players are generally accustomed to certain traditional prize of structures. For example, in a electronic or other slot machine, for a game outcome where the (best) result on any given pay line is a "cherry", players generally expect the traditional payback of two times the wager and, for two cherries on any one payline, a payback of five times the wager and so forth. Many players are so accustomed to the traditional prize amounts for many traditional games that players believe themselves entitled to at least the traditional payout and consider themselves mistreated if the payout is less than the traditional amount for a given prize. However, typical previous "free spin" gaming terminals have included at least one prize with a number of spins less than the spins that could be obtained by wagering the traditional payout. Additionally, some players will "shop" among electronic slot machine or other electronic gaming terminals, hoping to play those games which have higher or otherwise more desirable payback structures. It is believed that at least some players in this category will tend to avoid free spin games where free spins depart from traditional prizes for given outcomes (such as paying two free spins, rather than five, for a two-cherry game outcome) either because they perceive lower-quality payback or because the unfamiliar payback structure makes it difficult to compare or otherwise "shop" between gaming terminals.

In some previous approaches, an increase in size or frequency of a prize was funded by decreasing the hold amount. This approach, however, is generally unattractive to game operators and may be restricted by gaming regulations in certain jurisdictions. Another possible approach to funding an increase in the size or frequency of certain prizes would be to decrease the size of certain other prizes. However, such a change may make a game less attractive to players, particularly if it has the appearance of reducing one or more prizes below the level traditional for a given game output (such as reducing an award for a two-cherry outcome from five times the wager to four times the wager). Still another approach for funding an increase in the size or frequency of certain prizes is to decrease the win frequency for outcomes associated with another prize in the game. However, this approach can diminish attractiveness of a game if the players perceive the game having a relatively lower win frequency and in at least some jurisdictions it might be difficult or impossible to obtain approval for such a change or decrease in win frequencies.

Accordingly, it would be advantageous to be able to modify or create a game which, compared to previous games, can have a redistributed paytable such as having a higher value or frequency for certain prizes (preferably high-value prizes), but without the need for decreasing hold or for decreasing the frequency or the apparent (i.e., player-perceived) size of other prizes in the game.

SUMMARY OF THE INVENTION

In one aspect, some or all of the cost of restructuring a prize structure or paytable (such as increasing the size or frequency of certain, preferably larger, prizes) is paid for by the benefit obtained from substituting one or more free games for an amount of monetary payout which would normally suffice as the wagers needed to play such free games. I.e., rather than funding the increased size or frequency of prizes from a change in the hold or a decrease in the apparent size or frequency of other prizes, instead, a different (non-monetary) prize (a free game) is substituted for a monetary prize. The free prize or game is, it is believed, perceived by players as having (and, in at least some senses, from the point of view of player, actually has) the same value as wagers that would be required to play the same number of games; although, from the point of view of calculating the game payback, the value of a free game (for a less than 100% payback machine) is somewhat less than the size of the wager that would otherwise be required to play such game. Even though it is recognized that the players commonly use, e.g., accumulated "credits" to continue betting on or wagering on a gaming terminal, the award of a credit has a greater value than the award of a free game round or free spin because players have an option to convert a "credit" prize into a monetary prize if desired, while an additional game round or "free spin" prize cannot be converted into a monetary prize at the option of the player but can only be used for playing the game. Preferably, the game according to the present invention, compared to a traditional game with a commonly expected and understood prize structure for particular game outputs, and/or compared to the previous game which was modified to arrive at the game according to the present invention, reduces at least one prize by a monetary amount (in some cases, equal to the total amount of that prize) and substitutes a number of free spins or games equal to the number of games that could be obtained by wagering the amount of the prize reduction.

According to one aspect, a gaming terminal provides at least a portion of at least one prize in the form of at least one or more free game rounds. A benefit may be calculated as the difference between the value of the prize if paid out in coins or other monetary value and the value paid out as free game rounds. In one aspect, the benefit is redistributed in the paytable, preferably so as to provide a game in which the overall, long-term averaged payback amount is unchanged by the process of converting monetary payouts to free game payouts and redistributing the benefit thereof.

DETAILED DESCRIPTION OF THE PREFERRED EMBODIMENT

Figure 4:
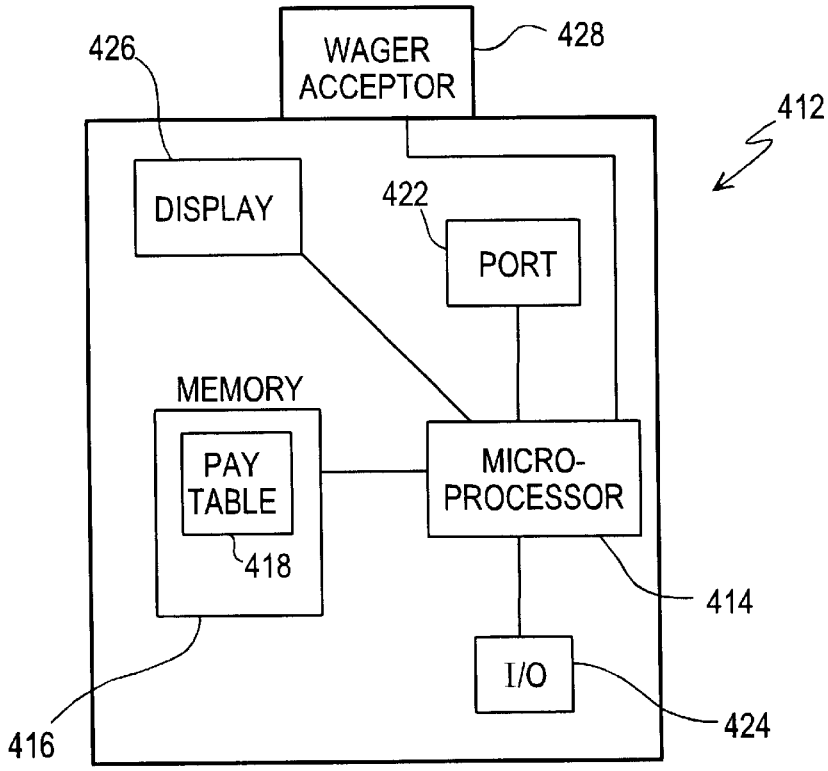
FIG. 4 is a block diagram depicting a gaming terminal which can be used in implementing embodiments of the present invention.

As depicted in FIG. 4, an electronic gaming terminal commonly includes a microprocessor 414 coupled to a memory 416 (such as random access memory, read only memory, flash memory and the like) for storing, among other things, programming code and one or more paytables 418. The microprocessor 414 may be coupled to an input/output (I/O) port 418, e.g., for coupling to an external computer or other external device. Other couplings to external computers can also be used including network cards or other network couplers, modems and the like. Typically, the microprocessor 414 is coupled to a variety of peripheral devices including, e.g., one or more I/O devices 424 (such as a plurality of keys or switches, a touch screen device, a mouse or other pointer, a printer and the like), a display 426 (such as a CRT, LCD display and the like) and a wager acceptor 428 (such as a coin acceptor, a bill validator, a credit card/debit card or other card reader and the like). Typically, regulatory approval is required for the gaming software and/or paytables stored in memory 416. In some cases, the memory 416 includes two or more pre-approved games and/or paytables which the game operator or casino can select among.

Typically, a player places a wager, using the wager acceptor 428, allowing the player to play one or more rounds of the game. Thus, from the point of view of the player, the wager required to play a round of the game represents the cost or worth of the round of the game. I.e., it is believed that players typically consider the cost or price of a round of game to be equal to the amount of the wager that must be placed in order for the player to be able to play a round of the game.

From the point of view of the casino or other game operator, however, the situation is somewhat different. From the point of view of the casino operator, the price or worth of a round of the game, to the player, is the amount the player, on average, receives in prizes from the average round of the game, i.e., an amount equal to the wager times the overall (long-term averaged) payback ratio of the game.

Although the present invention can be used in connection with a wide variety of different games, the following example is presented in terms of a slot machine game. In this example, it is assumed the slot machine game is a 90% payback, one-dollar wager machine. In this example, a player may place a one-dollar wager and, in return, receive the right to play one round (one "handle pull") of the slot machine game. Accordingly, from the player's point of view, typically, one round of this game is considered to be worth one dollar. From the point of view from the game operator, however, the operator knows that, since this is a 90% payback machine, in the long term average, the player will receive 90¢ for each round of game play. Accordingly, from the point of view of the game operator, every time the game operator allows the player to play a round of the game, the game operator has provided, to the player, something which has (on average) a value of 90¢.

In this example, the paytable may be reconfigured to, e.g. provide five free spins (rather than a monetary prize of $5.00) in response to a two-cherry game outcome. It is believed that, in this situation, players will generally perceive that there has been substantially no change in the size or value of the prizes, since, as noted above, it is believed players generally consider value of a round of game to be equal to the wager paid for that game and thus it is believed players will consider the receipt of five free spins, in response, e.g., to a two-cherry outcome, to be equivalent to the former prize of $5.00 in response to a two-cherry outcome.

According to an embodiment of the present invention, at least some of the prizes paid to the player are paid in the form of rounds of the game, rather than coins (or tokens, credits or the like). In this embodiment, some or all of difference in the value between the coin (token or credit) payout according to a previous paytable, and the (somewhat smaller) value of the round of game play is redistributed to another portion of the paytable, e.g., to increase the relative size or frequency of certain prizes in the paytable. In the above example, if the 90% payback, one-dollar wager slot machine has its paytable reconfigured such that, in response to a "two cherry" slot machine outcome, the player receives five free plays (instead of $5.00), the benefit (in this case, equal to 50¢) represented by awarding relatively lower-value prize, (preferably weighted according to the expected frequency of occurrence of the two-cherry game outcome) is used to fund an increase in the frequency and/or size of another prize, preferably in a manner such that the overall payback percentage of the machine can be configured to remain substantially the same, i.e., so as to still provide a 90% payback machine, in this example.

Although the present invention can be used for funding many types of paytable prize redistributions (preferably while substantially maintaining the same overall average payback percentage), preferably the invention involves providing free "spins" or other game rounds to replace relatively low monetary prizes (such as replacing monetary prizes which are less than or equal to about ten times the wager, preferably less than or equal to about five times the wager) and increasing size or frequency of relatively large monetary prizes (such as monetary prizes greater than or equal to five times the wager, preferably greater than or equal to about ten to twenty times the wager).

Figure 1:
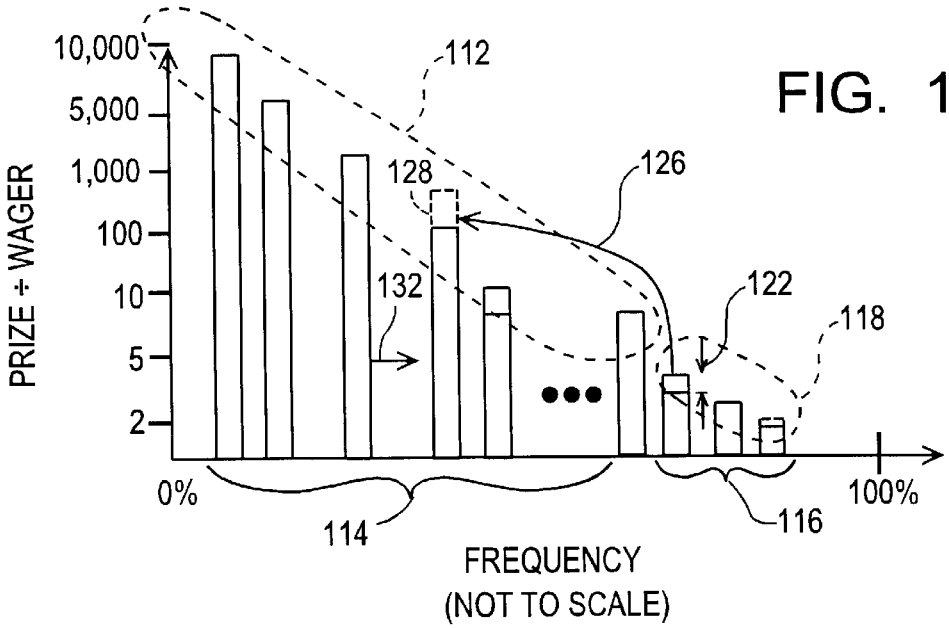
FIG. 1 is a depiction of a frequency distribution for various prizes of a type which can be redistributed according to an embodiment of the present invention.

As illustrated in FIG. 1, paytables are generally constructed such that prizes having a relatively high value, such as greater than five times the wager 112 have a relatively lower frequency of occurrence 114 compared to the frequency of occurrence 116 for prizes having a relatively lower value 118, such as less than about five times the size of the wager. As noted above, if a paytable is modified such that some or all of the monetary prize formally associated with one or more game outcomes such as low-value game outcomes 118 are, instead, paid as additional rounds of the game, the value of such additional rounds of the game, from the point of view of the game operator, will be less than the amount of the wagers which a player would normally need to play such a number of rounds of the game (even though players may perceive the values to be equal). From the game operator's perspective, the difference between the value of prizes paid out in the form of additional rounds of the game, and the value of the prize formerly paid out in coins or tokens (i.e., the amount of wagers that a player would need to place in order to receive such free rounds of the game) is referred to herein as the "benefit". Those of skill in the art will understand how to calculate the benefit. If the game is structured such that a prize won during a free spin can only be a monetary prize (i.e., a free spin cannot result in additional free spin prizes), then the benefit will be approximately equal to the value of wagers needed to be entitled to the free spins awarded, times the overall payback percentage of the game. If the game is configured such that a player may receive free spins as some or all of the prizes awarded as a result of a free spin, then the benefit will be somewhat less, as will be understood by those of skill in the art.

Thus, referring to FIG. 1, since substituting free spins for monetary prizes results in the value (from the point of view of the game operator) of one or more of the prizes being reduced by a certain amount 122, it is possible to redistribute this benefit 126 by adding to or increasing the size of one or more of the other prizes, e.g., 128. It is also possible to effect such redistribution by increasing the frequency 132 of one or more of the other prizes. Preferably, the magnitude of the change in the size or frequency of prizes is such that there is substantially no impact on the overall payback rate of the game (e.g. in the above example, such that the game is substantially kept as a 90% payback game). Those of skill in the art will understand, for a given benefit, how to redistribute the benefit, considering both the size of the change and the frequency of occurrence of various prizes, in a manner such that overall payback percentages of the game are substantially unchanged, if desired.

Figure 2:
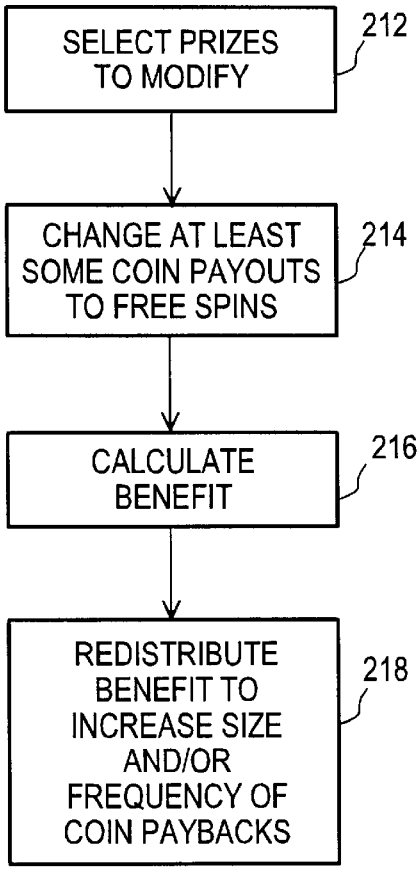
FIG. 2 is a flow chart depicting a redistribution process according to an embodiment of the present invention.

FIG. 2 illustrates steps in a procedure for redistributing benefits according to one embodiment of the invention. As depicted in FIG. 2, the process begins with selecting which of the prizes are to be modified 212. The selected prizes are modified by changing at least some of the coin payouts of the prize to free spin (or free game) prizes 214. The present invention can be used to modify (the entirety or portions of) any of the prizes in a game so as to change some or all of one or more prizes from monetary prizes to extra rounds of the game. In one embodiment, it is primarily the relatively smaller (and more frequent) prizes which are modified. In part, this is because it is believed most players are comfortable with receiving a modest number of free plays or free spins (which, in at least some embodiments, are played or initiated automatically, i.e., without the need or ability of the user to initiate, with a handle pull or otherwise) but that many players would find a game relatively less interesting if the gaming terminal were (especially automatically) playing a large number of free games. Since some games have relatively large prizes, such as (1,000, 5,000, 10,000 times the wager) it is believed that most players would find the game relatively less interesting if it provided, for example, 1,000 free games. Accordingly, one embodiment involves providing, in response to any one gaming output, no more than a predetermined number of free rounds of the game, such as less than 50, preferably less than 20 free rounds of the game.

The benefit which results from converting a monetary or coin payout to a free game round payout is calculated 216. This benefit is then redistributed 218. A number of types of redistribution are possible. Some or all of the benefit can be provided to the game operator in the form of an increase in the game hold. Some or all of the benefit can be distributed to players in the form of an increased payback percentage. However, in one embodiment, redistribution occurs in a fashion so as to avoid substantial changes in the payback percentage (or hold). In one embodiment the benefit is redistributed by increasing the size and/or frequency of other game prizes such as other coin payback prizes.

Figure 3:
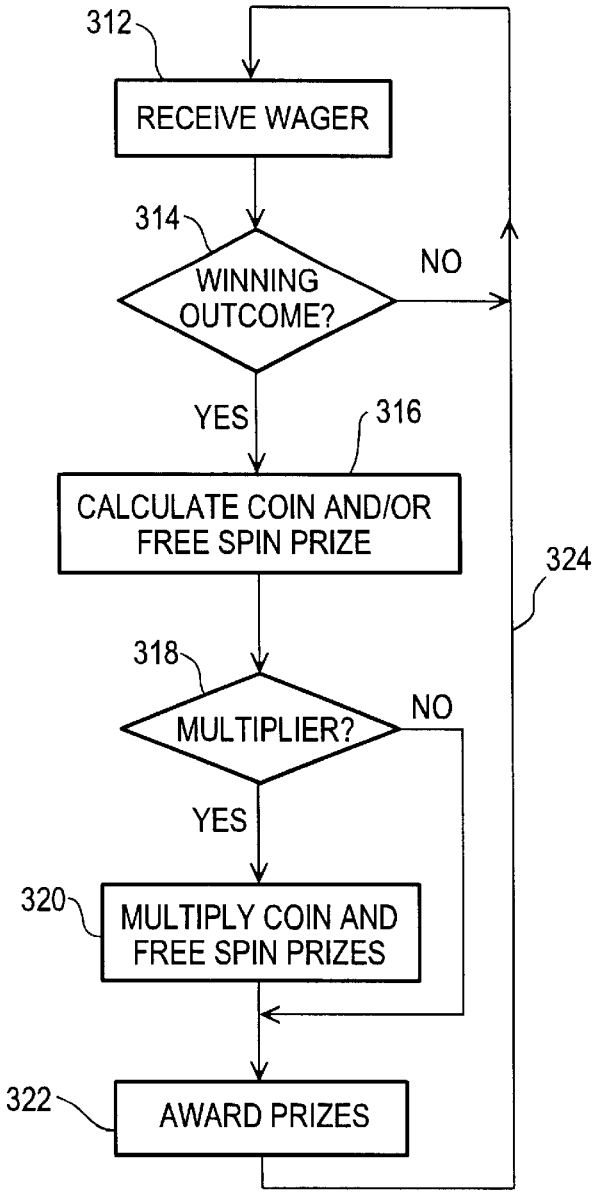
FIG. 3 is a flow chart depicting a gaming process according to an embodiment of the present invention.

During use of the game by a player, as illustrated in FIG. 3, the gaming terminal will receive a wager 312 and, following a play of a round of the game, determine whether the game outcome is a winning outcome 314. If not, play returns to allow the user to place additional wagers. If the outcome is a winning outcome, the gaming terminal will calculate (or will determine from, e.g., a lookup table) the amount and type of the prize, such as coin prizes and/or free spin prizes 316. In some games, as illustrated in FIG. 3, certain game outcomes include a multiplier indicator 318 such that prizes won are multiplied. If a multiplier outcome is detected, the multiplier is applied, preferably both to any coin prizes and any free spin prizes 320. For example, if a normal game outcome would result in two free spins and a 2×-multiplier occurs in the game outcome, the 2×-multiplier will be applied to the two free spins, to result in an award of four free spins. The appropriate prizes are than awarded 322 and the procedure loops 324 to permit return to normal play.

In light of the above description, a number of advantages of the present invention can be seen. The present invention not only provides additional game rounds or "free spins" as some or all of the value in certain prizes of the gaming terminal, but also recognizes and utilizes the difference between the value of a coin (or token or credit) prize and a game round or "free spin" prize. The recognition of existence of such benefit allows the benefit to be used in various manners including redistributing the prize structure within a game paytable. Thus, one feature of the present invention is that it affords the ability to restructure the game table, e.g., to provide a greater size or frequency of certain prizes (such as the relatively larger prizes) without the need to change the hold or payback frequency of the game and while providing the players with the perception that nothing has been taken away (e.g., since it is believed players tend to consider the value of a free game round as substantially equal to the size of a wager that could be required to play a game round). Preferably, the game rounds are substituted, one-for-one with respect to monetary prizes and are preferably substituted without changing the prize structure traditionally associated with certain games (such as the prize structures associated with traditional fruit-theme slot machine games, with those of skill in the art being familiar with prize structures which are traditional for certain games or game themes).

A number of variations and modifications of the invention can be used. It is possible to use some features of the invention without using others. For example, it is possible to redistribute the benefit of substituting free spins for monetary prizes, without restricting increases in prize size or frequency to only relatively larger prizes. Although illustrative examples of procedures have been provided, other procedures can also be used such as procedures having more or fewer steps and/or procedures in which steps are performed in an order different from that illustrated. Although embodiments of the present invention have been described in connection with the slot machine embodiment, some or all features of the present invention can also be implemented in connection with other electronic gaming terminals such as those configured for playing poker, blackjack, or other simulated card games, keno, roulette or other wheel games, and the like. Although embodiments have been described in which the benefit from free spin prizes is redistributed to larger-magnitude prizes in the paytable, it is also possible to provide a system in which some or all of the benefit is distributed to relatively lower-magnitude prizes. Although the present invention can provide for a redistribution of prizes, such as increasing the size or frequency of the relatively-larger-sized prizes, without the need for increasing the hold, it is also possible to fund a redistribution of prizes by a combination of the benefit obtained from substituting free spins for coin payouts and a change in the hold amount. Also, if desired, some or all of the benefits obtained as a result of substituting free spins for coin payouts can be used to increase the hold. Although the invention has been illustrated with respect to a one dollar wager machine example, the invention can be used with regard to many different wager-structured machines, including machines having other denominational wagers (25¢ wager machines, 5¢ wager machines, $5.00 wager machines and the like), machines in which the wager is based on a casino-minted or other token, and/or machines in which a user may select among a plurality of different potential wagers (such as deciding whether to wager one coin, two coins, five coins and the like). Although it is possible to provide embodiments in which a paytable is modified such that one portion of a prize is retained as a monetary prize while another portion is provided as free games (such as converting a prize of five coins into a combination of two coins plus three free game rounds) in other embodiments, all the coins, tokens or credits of one or more prizes are converted into an appropriate number of free game rounds (i.e., a number which could be obtained by wagering the prize).

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and/or reducing cost of implementation. The present invention includes items which are novel, and terminology adapted from previous and/or analogous technologies, for convenience in describing novel items or processes, do not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions. ranges or steps to those claimed, whether or not such alternate, interchangeable and/or equivalent structures, functions, ranges or steps are disclosed herein, and without intending to publicly dedicate any patentable subject matter.

What is claimed is:

1. A method for modifying a gaming paytable of a game wherein at least one game round play is required to be played, and one or more free game round plays are provided upon a winning outcome comprising:

substituting one or more free game round plays for at least part of at least one monetary payout, wherein a first benefit is created reflecting the lesser value of a free game round play compared to the value of a payout in an amount required as a wager from a player in order to obtain a game round play; and distributing at least part of said benefit in said paytable as an increase in the value or win frequency of another prize of said paytable.

2. A method, as claimed in claim 1, wherein said increase in the value or win frequency of another prize includes increasing at least a first payout amount.

3. A method, as claimed in claim 1, wherein said increase in the value or win frequency of another prize includes increasing frequency of at least a first prize.

4. A method, as claimed in claim 1, wherein said paytable includes a provision for multiplying at least a first free game round play in response to a first game output.

5. A method for modifying a paytable for a game, said game being a game of a type known to the art, wherein at least one game round play is required to be played, and one or more free game round plays a winning outcome comprising:

identifying, in said paytable for said game, at least one gaming outcome traditionally associated with a specific payout; and substituting, for said specific payout, a specific number of free game round plays, said specific number being at least one.

6. A method, as claimed in claim 5, wherein said specific number is equal to the number of plays that, in the traditional game, can be obtained from a wager equal to said specific payout.

7. Gaming apparatus in which at least one game round play is required to be played, and one or more free game round plays are provided upon a winning outcome comprising:

a gaming terminal including a microprocessor, said microprocessor operating to execute a stored program, wherein said stored program controls the microprocessor to output one or more free plays as a prize in response to at least a first gaming output traditionally associated with a monetary payout, wherein a first benefit is created equal to the lesser value of a free play compared to the value of a monetary payout in an amount equal to a wager necessary to obtain said free play; and wherein at least a portion of said benefit is distributed in said paytable by increasing an amount or a frequency of at least a second prize in said paytable.

8. An apparatus, as claimed in claim 7, wherein said redistribution is configured to provide an overall gaming terminal payback percentage substantially equal to the payback percentage of the gaming terminal having said monetary payout in place of said free play.

9. An apparatus, as claimed in claim 7, wherein said redistribution comprises an increase of at least a first payout amount.

10. An apparatus, as claimed in claim 7, wherein said redistribution includes an increase in a frequency of at least a first prize.

11. An apparatus as claimed in claim 7, wherein said paytable provides multiplying a prize in response to at least a first game outcome.

12. A gaming apparatus in which at least one game round play is required to be played, and one or more free game round plays are provided upon a winning outcome comprising:

at least a first processor for outputting prizes in accordance with a stored paytable;

means for receiving at least a first wager from a player; and wherein said paytable defines at least a first free game round prize and at least a second prize other than one or more free game rounds, said second prize having a magnitude or frequency, defined by said paytable, greater than a magnitude or frequency of a corresponding prize in a corresponding paytable without said free game round prize.

13. A method for modifying a gaming paytable of a game wherein at least one game round play is required to be played, and one or more free game round plays are provided upon a winning outcome which comprises:

substituting, for a specific cash prize of the unmodified paytable, one or more free plays of the game associated with the paytable as a non-cash prize, said cash prize having a specific value; and adding at least a portion of said specific value to another prize of the paytable.

14. The method of claim 13 in which the overall payback to the player of a machine using said paytable remains essentially unchanged.

15. The method of claim 13 in which the number of free games awarded as said non-cash prize essentially equals the specific value divided by the normal unit charge to a player of playing the game associated with the paytable.

16. A method for modifying a gaming paytable of a game wherein at least one game round play is required to be played, and one or more free game round plays are provided upon a winning outcome which comprises:

substituting, for a specific cash prize of the unmodified paytable, one or more free plays of the game associated with the paytable as a non-cash prize, said cash prize having a specific value; and increasing the odds of winning another prize of the paytable.

17. The method of claim 16 in which the overall payback to the player of a machine using said paytable remains essentially unchanged.

18. The method of claim 16 in which the number of free games awarded as said non-cash prize essentially equals the specific value divided by the normal unit charge to a player for playing the game associated with the paytable.

* * * * *